United States Patent [19]

Hütter

[11] 4,364,019

[45] Dec. 14, 1982

[54] MULTIPART ACTUATING MECHANISM

[76] Inventor: Hans-Georg Hütter Beckgasse 46, A 1130 Vienna, Austria

[21] Appl. No.: 113,447

[22] Filed: Jan. 21, 1980

[51] Int. Cl.[3] ..... H01H 36/00; H01H 19/20

[52] U.S. Cl. ..... 335/207; 335/303; 335/306; 200/67 F

[58] Field of Search ..... 335/207, 229, 298, 303, 335/306; 200/67 F; 246/249

[56] References Cited

U.S. PATENT DOCUMENTS 2,843,698 7/1958 Knauth ..... 335/207 X

*Primary Examiner*—G. Z. Rubinson
*Assistant Examiner*—S. D. Schreyer
*Attorney, Agent, or Firm*—McAulay, Fields, Fisher, Goldstein & Nissen

[57] ABSTRACT

A multi-part actuating mechanism formed of at least two correlated individual actuating elements contained within a housing. The actuating elements being arranged to move relative to each other and each being equipped with differently poled magnetic fields so that the fields are moved from a position in which identically poled magnetic fields oppose each other to one in which differently poled magnetic fields are opposite each other.

11 Claims, 11 Drawing Figures

MULTIPART ACTUATING MECHANISM

BACKGROUND OF THE INVENTION

The invention concerns a multi-part actuating mechanism with at least one active actuating element and at least one passive actuating element.

The fields of application of these actuating mechanisms are extremely manifold, and the object of the invention is to make a contribution to the widening and extension of these possible applications, and to ensure that the function assigned to the actuating mechanism is performed exactly and instantaneously, without having to overcome a mechanical force starting this operation, e.g. a spring force.

Another object of the invention is to define as accurately as possible the various operating positions of the actuating mechanism and to ensure a tight contact of the actuating elements with the exclusion of intermediate positions.

Still another object of the invention is to provide a particularly space-saving and rugged actuating mechanism which represents a compact unit and which contains no parts that are susceptible to trouble, breakage or wear.

All these objects of the invention are achieved according to its most essential feature in such a way that the correlated actuating elements moving relative to each other are equipped with differently poled permanent magnetic fields and can be shifted between a position in which their differently poled fields oppose each other and a position in which their identically poled fields oppose each other.

Depending on whether these actuating elements in the actuating mechanism oppose each other with identically or differently poled fields, they repel each other or attract each other.

The invention is based on the finding that it requires in this way only a relatively minor change in the position of the actuating elements at least one of which is a passive actuating element and another of which is an active actuating element positioned within a housing and movable relative to each other to cause a sudden change in the behavior of the actuating of the magnetic fields is very accurate and very sudden. This behavior of the actuating elements can be utilized with advantage for the operation of the actuating mechanism.

The absence of troubles in the subject of the invention is ensured by the fact that it requires no loose small parts, like springs, screws and other precision-mechanical or sensitive parts and is thus not subject to marked wear.

Actuating mechanisms according to the invention are particularly suitable as electric switches, where the two types of actuating elements are arranged opposite each other in a common housing and can be designed as carriers of electrical lines or contacts. Beyond that, however, the actuating mechanisms according to the invention can be used as motion converters for many other purposes, e.g. as a high-grade replacement for releases, couplings and similar mechanical elements. The actuating element according to the invention can also replace in such applications both a spring and a coupling, because the instantaneous contact-making of the actuating elements always results in non-positive coupling, due to the adhesion of the permanent magnetic fields.

In order that the invention will be clearly understood and readily carried into effect the same will be described in connection with the accompanying drawings.

BRIEF DESCRIPTION OF THE DRAWINGS

FIG. 1*a* shows the switch in one of its three contact positions, FIG. 1*b* shows the switch in another of its contact making positions for another form of connection, and FIG. 1*c* shows the switch in its third form of connection;

FIG. 2*a* shows one position and FIG. 2*b* shows another position of housing after tilting thereof in a direction opposite to FIG. 2*a*, and FIG. 2*c* shows a detail of one of the actuating elements removed from the housing for greater clarity and ease of explanation;

FIGS. 3*a*, 3*b* and 3*c* show three different positions of operation, and FIG. 3*d* shows a rocker in combination with the actuating elements and operatively connected with the active actuating elements;

FIGS. 7*a* and 7*b* are a partial elevational and partial sectional view of a soccer game employing the multipart actuating switch according to one or more of the embodiments of FIGS. 1 to 6;

The drawings illustrate in FIGS. 1–6 various actuating mechanisms which are designed as electric switches, partly in schematic cross sections and partly in perspective views. FIGS. 7–11 show the actuating mechanisms of FIGS. 1–6 in various other possible uses of the subject of the invention, and partly in top views, partly in cross sections.

DETAILED DESCRIPTION OF THE PREFERRED EMBODIMENTS

Figure 1:
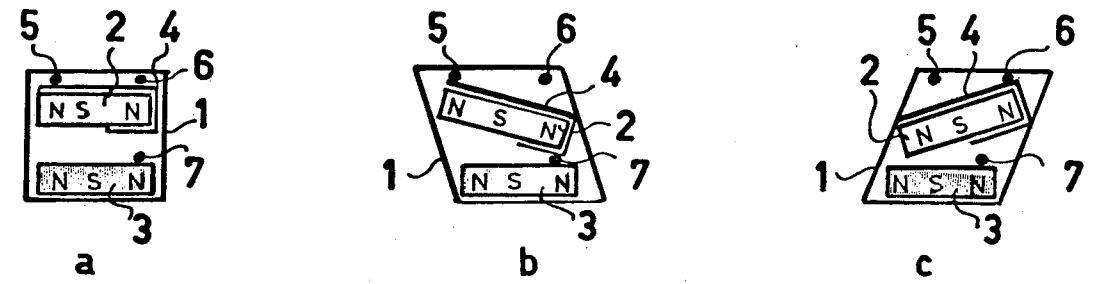
FIG. 1 is a multi-part actuating switch mechanism shown in three different operative positions.

In the actuating mechanism according to FIG. 1 designed as a switch are arranged opposite each other inside a common, deformable housing 1, which is formed e.g. of a plastic tube, an active actuating element 2 moving freely inside this housing 1, and a passive actuating element 3 connected with this housing 1. Actuating elements 2 and 3 are equipped with differently poled permanent magnetic fields, carrying strip-shaped permanent magnets of different polarity arranged parallel side by side, which are designated with N and S. The freely moving active actuating element 2 carries contact panels 4 which connect in position a of this actuating element 2 conductors 5 and 6 with each other which are arranged inside housing 1. A conductor 7 is assigned to or associated with the passive actuating element 3.

This switch according to FIG. 1 is adjustable in three positions, depending on the type of deformation of its housing 1, as it can be seen from the represented positions a, b and c, where either conductors 5 and 6 are connected with each other in position a, or conductors 5 and 7 in position b, or none of the conductors is connected with another conductor in position c. In position a, the identically poled zones of the actuating elements oppose each other, consequently actuating element 2 is pressed magnetically toward lines 5 and 6; in position b, the right-hand N-pole of actuating element 2 is pulled closer to the central S pole of actuating element 3 and is thus attracted, consequently contact panel 4 of lines 5 and 7 connects this actuating element 2, and the same holds true for the left-hand N-pole of actuating element 2 in position c, so that a contact-free position is obtained.

This switching mechanism is actuated in an extremely simple manner by the deformation of housing 1. If the switch is designed, for example, as a strip, rail, bar or a similar oblong body and is freely accessible, the deformation and the adjustment respectively of the active actuating element 2 can take place at any point of the longitudinal course of this strip etc. Due to the action of the differently or identically poled magnetic fields opposing each other, the respective selected position is reliably maintained, either by rejection of these fields according to position a or by attraction of differently poled fields according to positions b and c.

Figure 2:
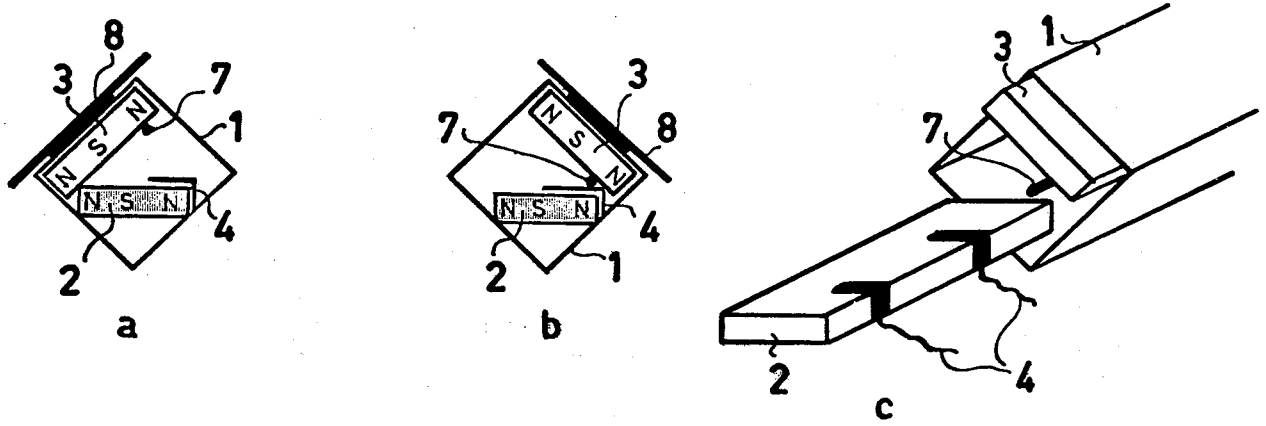
FIG. 2 is a modification of the multi-part switch of FIG. 1 in which the housing containing the actuating elements is tiltably mounted.

In the switch according to FIG. 2, housing 1 is movably, for example, tiltably mounted together with actuating element 3 with regard to actuating element 2, and is connected on its outside with a carrier 8 provided for actuation and or fastening. FIG. 2 shows in a perspective view the various parts of this switch which can also have a round profile, if desired, and be actuated by rotation.

Figure 3:
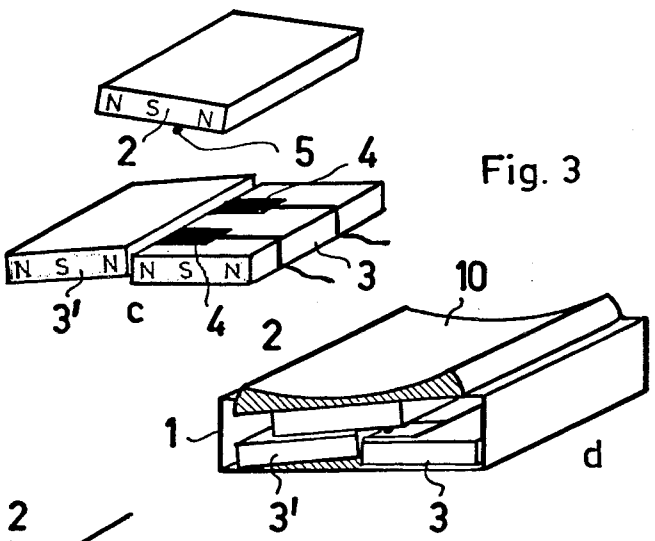
FIG. 3 is another embodiment of the invention in which at least one active actuating element and at least two passive actuating elements are contained within a housing.

FIG. 3 shows a variant where two passive actuating elements 3 and 3' are assigned to an active actuating element 2 with a conductor 5, of which only one (3 for example) forms the carrier of contact panels 4, while the other (3') merely serves for holding the active actuating element 2, magnetically which is tiltably mounted, for example, and moved according to FIG. 3*d* by means of a rocker 10 in the open position a of the switch. By means of this rocker, the active actuating element 2 secured thereon can be tilted into position b, where it adheres with conductor 5 on contact panel 4 of the passive actuating element 3 and connects this conductor 5 with contact panel 4.

Figure 4:
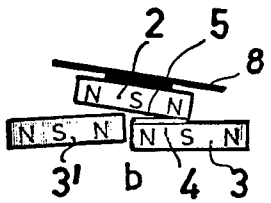
FIG. 4 is another modification in which the actuating elements are mounted within the housing in a parallel relationship to each other, and one of the elements is active and the other is passive, with the active element being movable in a parallel direction relative to the passive actuating element from a first position shown in FIG. 4*a* to a second position shown in FIG. 4*b;*
Figure 4:
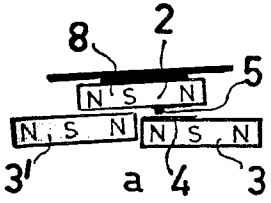
Figure 4:
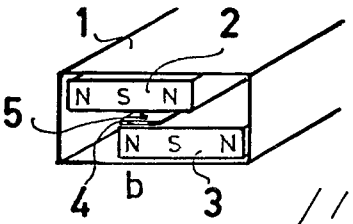
Figure 4:
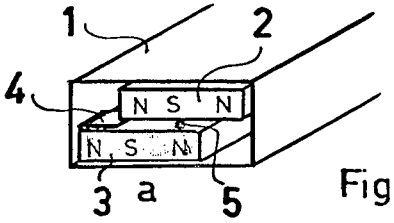

FIG. 4 shows a switch whose housing 1 contains two actuating elements 2 and 3, which can be displaced parallel to each other, of which one carries a conductor 5, and the other contact panels 4. These actuating elements 2 and 3 are displaceable from a rest position in which they attract each other over a displacement path in which they repel each other into a contact position b, in which they attract each other again. The contact making is thus always sudden without sparking.

Figure 5:
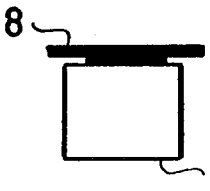
FIG. 5 is another modification with the active actuating element movable together with the housing in a transverse direction from the FIG. 5*a* position towards the FIG. 5*b* position and away from the passive actuating element which is also contained within the housing.
Figure 5:
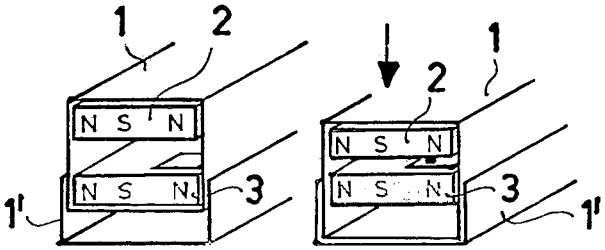

In the embodiment according to FIG. 5, the actuating elements 2 and 3 are mounted inside a housing 1, which in turn is displaceable in a guide 1'; these actuating elements can be moved from a rest position a, in which they are spaced from each other toward each other to give off a pulse, and can be kept in contact with each other for a desired time.

Figure 6:
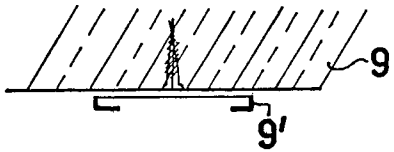
FIG. 6 is a schematic showing of a housing which is completely sealed and containing the actuating elements operable from the outside thereof and attached to a carrier.

Essential advantages of these switches according to FIGS. 1–5 consist in that housings 1 can be tightly sealed as schematically shown in FIG. 6 because their interior need not be accessible and they can be attached to a carrier 8 as in FIG. 2; besides, thin partitions can be provided inside the housing between the actuating elements without hindering the magnetic flux. Such chambers can be made liquid-tight, like the housing itself.

Beyond that, the subject of the invention can also be used successfully in many other fields, of which only a few will be mentioned below by way of example.

Figure 7:
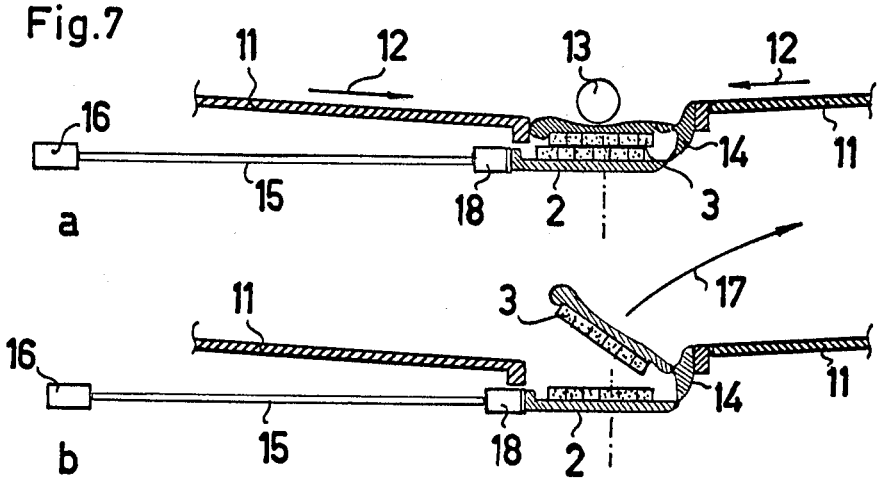
Figure 8:
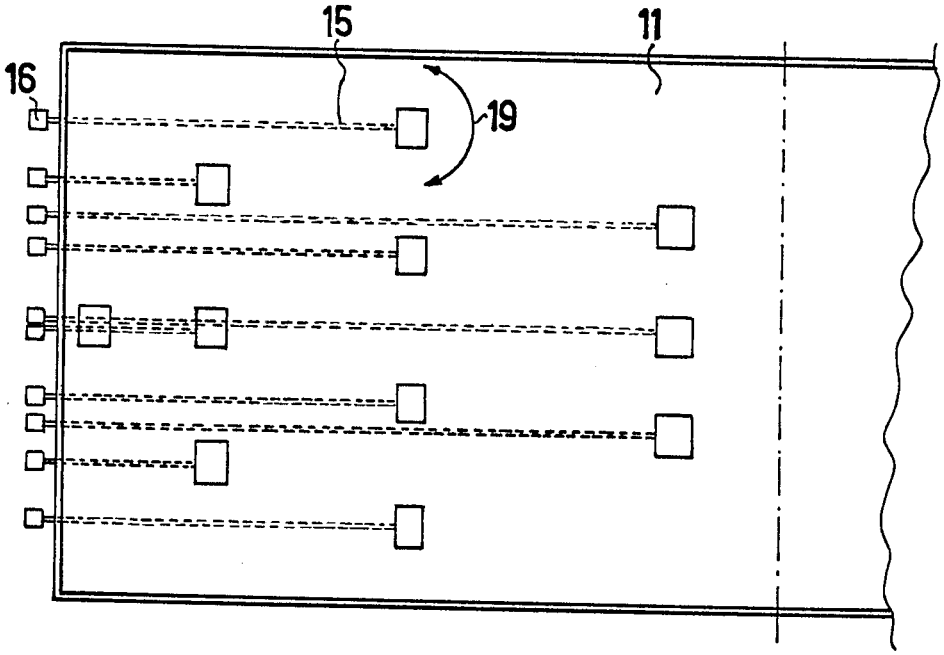
FIG. 8 is a plan view of the soccer game of FIG. 7.

FIGS. 7 and 8 show details of a table soccer game where actuating elements according to the invention can be used to generate sudden pulses.

The passive actuating element 3 forms according to FIG. 7*a* the bottom of a flat trough in plane 11; to EACH fictional player is assigned such a trough zone, as indicated in FIG. 8, in which ball 13 stops, thanks to the gradient of the trough wall. Carrier strip 14 carries underneath the passive actuating element 3 an active actuating element 2 which is connected, e.g. by means of a rod 15 etc. with an associated handle 16 which is accessible at the end face of the table. By displacing the active actuating element 2, the passive actuating element 3 can be repelled and moved upward to shoot a ball 13 in the direction of the opposite goal, hence in the direction of arrow 17, as indicated in FIG. 7*b*.

Rod 15 could be connected with carrier strip 14 over a small gear 18 in order to be able to turn this carrier strip sideways by rotating the rod about its axis and to impart ball 13, in addition to the throwing pulse, a selected lateral direction within a certain circular range 19 (FIG. 8).

Figure 9:
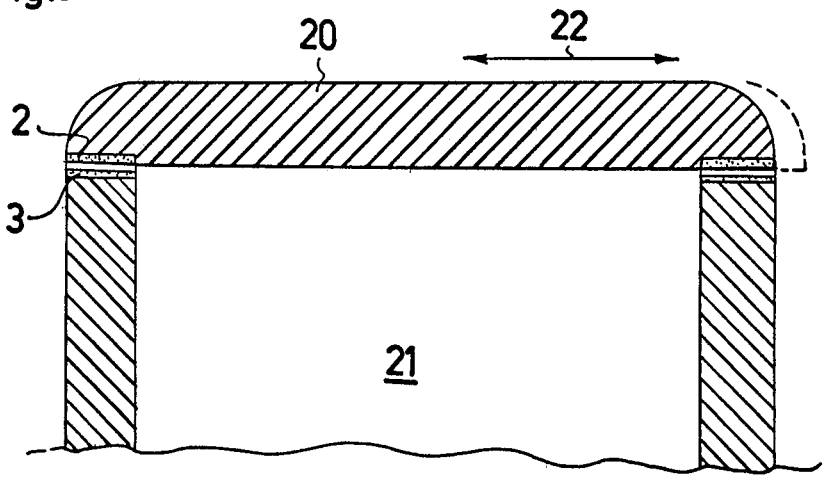
FIG. 9 is a transverse sectional view of a container with a non-circular cross-section and lid in which the lid can be displaced transversely if said container with at least one actuating element contained in the lid and another actuating element contained in the rim of the container.
Figure 10:
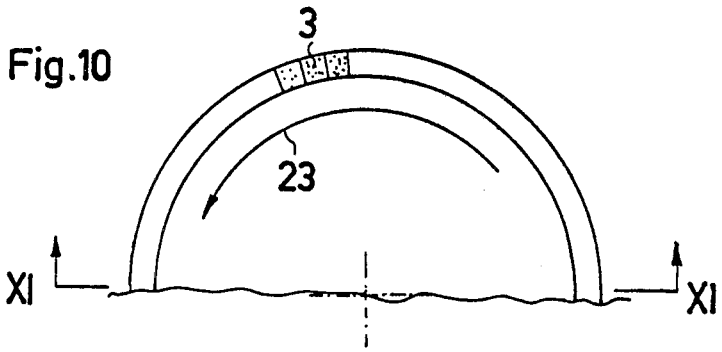
FIG. 10 is a top view of a container with a circular cross-section illustrating one of the actuating elements in the lid for cooperation with another actuating element in the rim of the container together with joining means to permit and provide for the rotation of the lid of the container relative to the body of the container; and, FIG. 11 is a vertical sectional view of the container and lid of FIG. 10.
Figure 11:
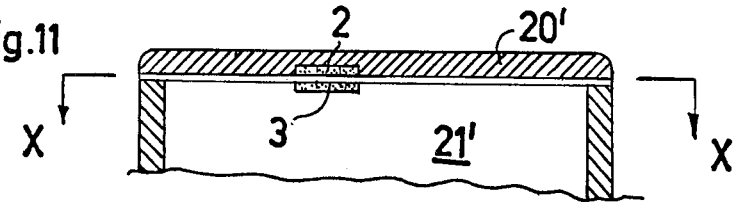

FIGS. 9–11 show applications of the subject matter of the invention in connection with container closures. FIG. 9 shows a lid 20 which can be displaced laterally from its closing position, indicated by solid lines, in which the magnetic fields 2 and 3 attract each other due to their different polarity and thus retain the lid tightly on bottom part 21 in either one of the two directions of arrow 22, to bring these magnetic fields into a position in which they repel each other and thus release lid 20.

The magnets 2 and 3 have substantially the same function in the case of the container closure according to FIGS. 10 and 11. Lid 20 which is round only has to be turned relative to bottom part 21' to transform the magnetic attraction holding line 20' into a repulsion, thus releasing the lid.

The invention can also be used on doors, windows and furniture, as well as an additional safety device on locks, also as a control device for conveyer and sorting installations, as an ejector or dispenser in vending machines, or as a gripper e.g. in prostheses. Conceivable is also the use of the subject of the invention for the production of a reciprocating alternating movement, for example, folding movements, swinging movements, etc. A movably mounted, e.g. rotating or longitudinally displaceable body, which has differently poled fields, can be so moved under a likewise magnetically poled carrier that it alternately atrracts and repels this carrier in regular intervals, thus imparting to it jarring movements. This arrangement can be realized in the form of a tape whose possible uses are manifold. Furthermore, in the garment industry, tapes with differently poled zones can be alternately connected with each other and detached from each other similar to a zipper, opposing each other or bearing on each other at their edges, if necessary, by longitudinal zones designed according to the invention.

In all these cases it is of advantage that the invention can provide an exactly controllable abrupt change between tight adhesion of the actuating elements, on the one hand, and repulsion of the same actuating elements, on the other hand. Furthermore it is a great advantage that the coupling and repelling action of the magnetic fields is only slightly reduced by intermediate layers, so that the subject of the invention can also be used, e.g. when the actuating elements are separated from each other by walls, for example, by liquid-tight diaphragms, without requiring any shifting elements which trasverse such a wall. This advantage has the particularly favorable effect that actuating elements according to the invention can be encased gas-tight, if necessary; the cavities in which these actuating elements are arranged can therefore be filled, for example, in switching mechanisms, with an electrical protective gas, such as nitrogen, noble gases, etc.

I claim:

1. An electrical switch comprising a deformable housing:

and in said housing a plurality of electrically conductive contacts adapted for insertion in an electrical circuit;

enclosing a first and a second actuating elements which are movable relative to each other for connecting and disconnecting said contacts to close or break said circuit;

each of said actuating element comprising permanent magnetic poles, at least one of the poles of said first element being movable from a position wherein it is attracted by at least one of the poles of said second element to a position where it is repelled by at least one of the poles of said second element, and wherein said actuating elements being movable from one of said positions to the other position by changing the shape of said housing.

2. The electrical switch according to claim 1, wherein said housing is substantially parallelepipedal in shape and is formed from a deformable material, said actuating elements being positioned close to the walls of said common housing for shifting the actuating elements relative to each other, said common housing being deformable so that the walls thereof can be shifted relative to each other from a form with a rectangular or square cross section in which all interior angles are equal to a form with rhomboic or rhomboid cross section in which the opposite interior angles are equal.

3. The switch according to claim 2, wherein at least one of said correlated actuating elements is fixedly mounted relative to said housing and forms a passive actuating element; and, at least one of said correlated actuating elements is movably mounted in said housing relative to said passive actuating element and forms an active actuating element.

4. The switch according to claim 3, wherein said housing together with said active actuating element is rotatable relative to said passive actuating element.

5. The switch according to claim 3, wherein said housing together with said active actuating element is movable transversely towards and away from said passive actuating element.

6. The switch according to claim 3, wherein said housing together with said passive actuating element is rotatable relative to said active actuating element.

7. The switch according to claim 1, wherein at least one of said actuating elements is round;

said housing also being round and carrying said other actuating elements; and, said one actuating element being rotatable relative to said other actuating element.

8. The switch according to claim 1, wherein at least one of said two actuating elements is fixed to said housing and at least another of said two actuating elements is fixed relative to said housing; and, said housing being movable together with said at least one actuating element relative to said other actuating element.

9. The switch according to claim 1, wherein two of said actuating elements are passive actuating elements and another of said actuating elements is an active actuating element; and, a rocker is provided associated with said housing and said active actuating element for movement among three different positions to produce three different poled magnetic relationships among said active actuating element and said two passive actuating elements;

one of said passive actuating elements being a contact carrier and the other of said passive actuating elements cooperating with said active actuating element to hold the switch in an open position.

10. The switch according to claim 1, wherein said actuating elements each includes a like three poled magnet with the poles distributed in the same manner.

11. The switch according to claim 1, wherein said housing is tightly sealed and free of accessibility.

* * * * *